United States Patent [19]

Quist, Jr.

[11] Patent Number: 4,729,179

[45] Date of Patent: Mar. 8, 1988

[54] SHOE INSOLE

[75] Inventor: Barr Quist, Jr., Locust, N.J.

[73] Assignee: Kinney Shoe Corporation, New York, N.Y.

[21] Appl. No.: 879,978

[22] Filed: Jun. 30, 1986

[51] Int. Cl.[4] ..... A43B 13/38; A43B 13/41

[52] U.S. Cl. ..... 36/44; 36/76 C

[58] Field of Search ..... 36/2.6, 91, 92, 43, 36/44, 71, 76 C; 428/236, 282, 461

[56] References Cited

U.S. PATENT DOCUMENTS

| | | | |
|---|---|---|---|
| 643,607 | 2/1900 | Reed | 36/44 |
| 1,721,549 | 7/1929 | Eaton | 36/77 M |
| 2,284,947 | 6/1942 | Clifford | 36/44 |
| 2,330,398 | 9/1943 | Vass | 36/91 X |
| 2,379,366 | 6/1945 | Lumbard | 36/71 X |
| 2,641,068 | 6/1953 | Thompson | 36/44 |
| 2,644,250 | 7/1953 | Ciaio | 36/76 C |
| 2,736,109 | 2/1956 | Scholl | 36/44 |
| 3,292,277 | 12/1966 | Teschon | 36/71 |
| 3,414,988 | 12/1968 | Mattos | 36/91 X |
| 3,418,732 | 12/1968 | Marshack | 36/44 |
| 3,500,561 | 3/1970 | Epstein | 36/92 |
| 3,506,531 | 4/1970 | Stander | 428/236 |
| 4,020,570 | 5/1977 | Shames | 36/44 |
| 4,055,699 | 10/1977 | Hsiung | 428/311 |
| 4,223,458 | 9/1980 | Kihara | 36/44 |
| 4,263,727 | 4/1981 | Bender et al. | 36/44 |
| 4,524,529 | 6/1985 | Schaefer | 36/98 |
| 4,541,186 | 9/1985 | Mulvihill | 36/71 X |

*Primary Examiner*—Stephen Marcus
*Assistant Examiner*—T. Graveline
*Attorney, Agent, or Firm*—Kenyon & Kenyon

[57] ABSTRACT

A multi-layer shoe insole comprises a lowermost metal layer connected to a polyethylene foam layer via a film of polyethylene. An uppermost layer in the form of a felt material is connected to the polyethylene foam via a textile net embedded in a layer of synthetic resin. The insole is provided with a removably attached arch support and a removably attached heel cup. The layers of the insole are stitched to one another by a pair of threads which also serve to maintain the peripheral edge of the insole are a smooth line.

23 Claims, 4 Drawing Figures

SHOE INSOLE

BACKGROUND OF THE INVENTION

This invention relates to a multi-layer shoe insole.

Many efforts have been made to provide shoe insoles having advantageous combinations of characteristics or properties such as insulation, strength, durability and comfort. For example, as disclosed in U.S. Pat. No. 4,263,727 to Bender et al., a sheet for the manufacture of cushioned insoles comprises a substrate of bonded fibrous material flame laminated to a foamed plastic layer composed of closed-cell crosslinked polyolefin, particularly polyethylene. A woven cover layer is likewise flame laminated to a side of the foam layer opposite the substrate. The insole material automatically adapts itself to the orthopedic shape of a foot in the various zones thereof and possesses high resistance to chemical aging.

As set forth in U.S. Pat. No. 4,055,699, a multi-layer shoe insole particularly adapted to insulate the foot from cold developed in the shoe sole owing to the wearer's walking on a cold surface comprises a thin top layer of nylon felt material, a second layer of thermoplastic foam cushioning material immediately beneath the top layer, a third layer of cross-linked high density polyethylene and a bottom layer of aluminum coated polymeric material. The second layer of the insole is preferably made of polyurethane foam impregnated with polyvinyl chloride foam. The bottom layer is embossed to provide a pebble-grain effect for preventing the insole from slipping within an article of footwear.

U.S. Pat. No. 2,736,109 is directed to a laminated insole including a central metallic layer disposed between two composite laminations each including an inner layer of foam latex and an outer layer of fabric material.

A shoe insole illustrated and described in U.S. Pat. No. 2,641,068 to Thompson includes an inner layer aluminum foil backed on one side by a sheet of gauze or other cloth and on an opposite side by a black heat-absorbing material such as black felt. On an outer side of the insole on the same side thereof as the heat-absorbing material is provided a layer of durable material such as light-weight woven cloth separate from or combined with the heat-absorbant material.

U.S. Pat. No. 2,284,947 to Clifford teaches a heat-insulating insole comprising a lower layer of aluminum foil and an upper layer of a relatively coarse fiber.

An object of the present invention is to provide an improved multi-layer shoe insole.

Another, more particular, object of the present invention is to provide an improved shoe insole which is especially effective in thermally insulating a wearer's foot.

Another particular object of the present invention is to provide such a shoe insole which additionally cushions the wearer's foot.

Yet another particular object of the present invention is to provide such a shoe insole which is flexible and yet strong.

A further object of the present invention is to provide such a shoe insole which absorbs and temporarily stores perspiration from the wearer's foot.

A yet further object of the present invention is to provide such a shoe insole which has a smooth peripheral edge.

Another particular object of the present invention is to provide such a shoe insole with a readily removable arch support member and a readily removable heal support member.

SUMMARY OF THE INVENTION

A shoe insole in accordance with the present invention includes a lowermost layer in the form of a metal foil for reflecting heat energy to thermally insulate a person's foot. The insole includes an uppermost layer of felt material for absorbing and temporarily storing moisture from the sole of the person'foot. A flexible layer of polyethylene foam is disposed between the metal layer and the felt material for insulating and cushioning the person's foot. In addition, a reinforcement layer for lending strength and stability to the insole includes a textile net or fabric material embedded in a layer of thermoplastic resin disposed between the felt material and the layer of polyethylene foam. The insole also includes coupling means for connecting the layers to one another and for maintaining those layers in an integral configuration.

The reinforcement layer, including the textile net embedded in the thermoplastic resin, not only lends strength and stability to the insole but also prevents perspiration absorbed by the felt material from entering the polyethylene foam and thereby reducing the effectiveness of that layer as thermal insulation.

Pursuant to another feature of the present invention, the insole further comprises means for maintaining the peripheral edge of the insole in a smooth configuration. This means for maintaining includes a first thread looping from a lower surface of the insole to an upper surface thereof around the pheripheral edge of the insole. A second thread is stitched through all of the insole layers to form a seam extending around the insole parallel to the pheripheral edge thereof. The first thread extends through loops formed by the second thread at the upper surface and through other loops formed by the second thread at the lower surface. It is to be noted that the two threads, particularly the second thread, also serve to couple the layers to one another.

Pursuant to further features of the present invention, an additional layer of unfoamed polyethylene is disposed between the polyethylene foam and the metal foil, while a synthetic resin arch support and a synthetic resin heel support are removably attached to a lower surface of the metal foil by means of an adhesive. The metal foil is advantageously provided with an embossed pattern.

The uppermost layer of the insole, i.e., the felt material, is advantageously composed of polyethylene and polypropylene fibers and serves to perform an insulating and a cushioning function as well as an absorption and storage function.

DETAILED DESCRIPTION

Figure 2:
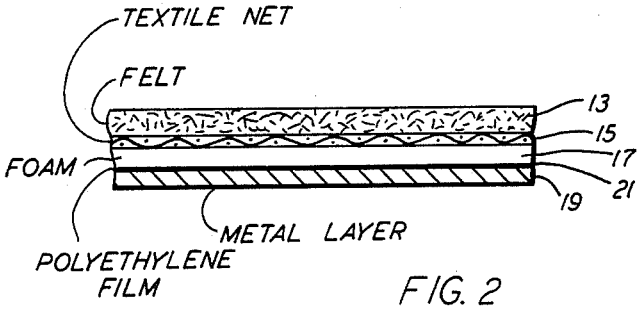
FIG. 2 is a partial cross-sectional view taken along line II—II in FIG. 1.

As illustrated in the drawing, particularly FIG. 2, a multi-layer shoe insole 11 comprises an uppermost layer 13 composed of a polypropylene and polyethylene felt 4 to 5 mm in thickness. The felt layer performs several functions including (a) thermal insulation (b) cushioning and (c) absorption and temporary storage of perspiration from a wearer's foot.

A second layer 15 disposed immediately below felt layer 13 includes a textile net or fabric material embedded in a synthetic resin layer. Textile and synthetic resin layer 15 provides stability to and reinforces the entire insole. In addition, layer 15 forms a moisture barrier preventing the moisture absorbed by felt layer 13 from migrating to other portions of the insole.

A third layer 17 is a flexible styropole (polyethylene foam) layer which performs a thermal insulation and a cushioning function. Foam layer 17 is connected by a thin polyethylene film 21 to a fourth layer 19 in the form of a metal foil. In a cold environment, e.g., on snow and ice, metal foil 19 serves to reflect heat generated by a person's foot back into the shoe. In a hot environment, e.g., a desert, metal foil 19 serves to reflect heat from the desert floor away from the foot. Polyethylene film 21 reinforces metal layer 19 and facilitates the lamination of that layer to foam layer 17.

Layers 13, 15, 17, 19 and 21 are laminated to one another by conventional processes, including the application of an adhesive between adjacent layers and the application of pressure exemplarily by counter-rotating rolls (not illustrated).

Figure 1:
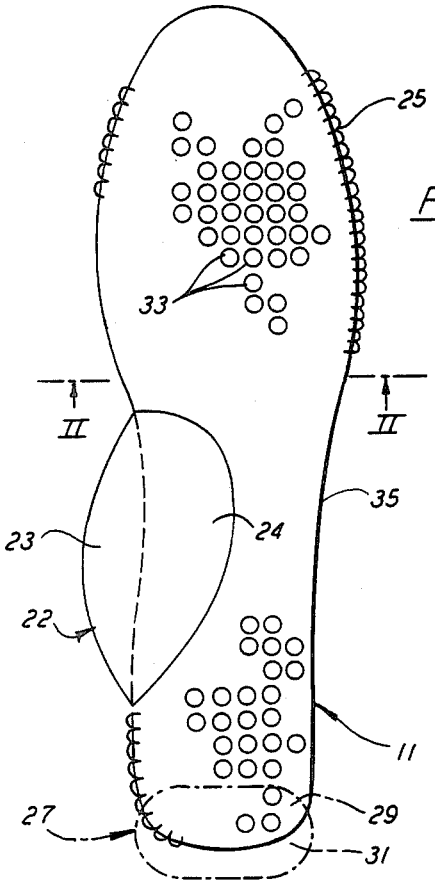
FIG. 1 is a bottom view of a multi-layer shoe insole in accordance with the present invention.

As illustrated in FIG. 1, the insole 11 is advantageously provided with a synthetic resin arch support 22 having a first portion 24 provided with adhesive for removably attaching upon the arch support to a lower surface of metal foil 19. Upon attachment of arch support 22 to insole 11, portion 24 of arch support 22 extends substantially parallel to metal foil 19. Another portion 23 of arch support 22 extends generally upwardly away from portion 24.

Insole 11 is also advantageously provided with a heel support 27 having a first portion 29 extending parallel to metal foil 19 and removably secured thereto by means of an adhesive. Heel support 27 further includes a second arcuate portion 31 extending out of the plane of portion 29 to form a cup for the accommodation of a wearer's heel.

As illustrated in FIG. 1, metal foil 19 is embossed with a regular pattern of shallow circular projections 33 which serve in part to increase the gripping of the insole in a wearer's shoe.

Figure 3:
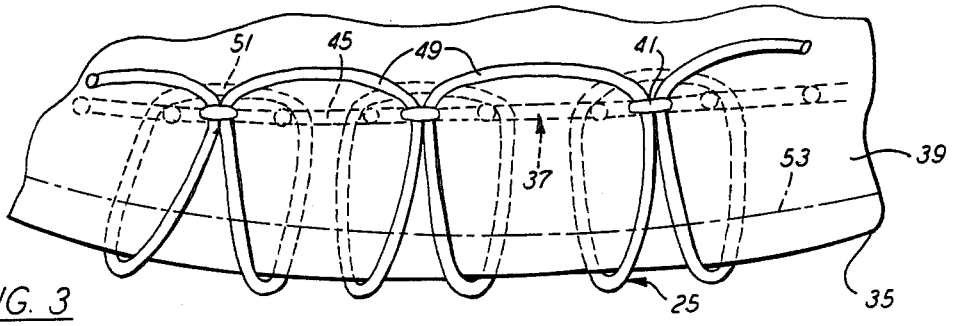
FIG. 3 is a partial top or plan view, on an enlarged scale, of the shoe insole of FIG. 1, showing a pair of threads cooperating with one another to couple the layers to one another and to maintain the peripheral edge of the insole in a smooth line.
Figure 4:
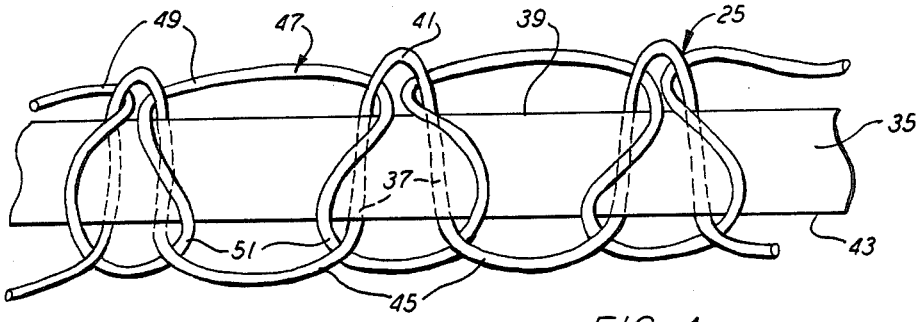
FIG. 4 is a partial side elevational view of the subject matter illustrated in FIG. 3.

As illustrated schematically in FIG. 1 and as shown in detail in FIGS. 3 and 4, insole 11 is provided at a peripheral edge 35 with stitching 25 which serves in part to fasten layers 13, 15, 17, 19 and 21 to one another and to maintain edge 35 in a smooth line or configuration. Stitching 25 includes a first thread 37 sewn in zig-zag fashion through layers 13, 15, 17, 19 and 21 of insole 11 to form on an upper side or surface 39 of insole 11 a series of loops 41 spaced from one another in a linear array extending parallel to edge 35 and to further form at a lower side or surface 43 of insole 11 another series of loops 45 spaced from one another in another linear array parallel to edge 35. A second thread 47 is looped from upper surface 39 to lower surface 43 around edge 35. Thread 47 extends through loops 41 at upper surface 39 and also extends through loops 45 at lower side or surface 43. As illustrated in FIGS. 3 and 4, thread 47 forms a series of loops 49 at upper insole surface 39 and another series of loops 51 at lower insole surface 43, loops 49 alternating with loops 51 along the length of thread 47. A third thread 53 is sewn in a zig-zag fashion through the layers of insole 11.

Although the invention has been described in terms of particular embodiments and modifications, one of ordinary skill in the art, in light of this teaching, can generate additional embodiments and modifications without departing from the spirit of or exceeding the scope of the claimed invention. Accordingly, it is to be understood that the descriptions and illustrations herein are proferred by way of example to facilitate comprehension of the invention and should not be construed to limit the scope thereof.

What is claimed is:

1. A shoe insole comprising:

a layer of metal foil;

a layer of felt material forming an uppermost layer in the insole, said layer of metal foil forming a lowermost layer in the insole;

a flexible layer of polyethylene foam disposed between said metal foil and said layer of felt material;

a textile net embedded in a layer of thermoplastic resin disposed between said layer of felt material and said layer of polyethylene foam; and coupling means for connecting said layer of felt material, said texile net, said layer of polyethylene foam and said metal foil to one another and for maintaining same in an integral configuration.

2. The insole recited in claim 1 wherein the insole has a peripheral edge, further comprising means for maintaining said edge in a smooth configuration, said means for maintaining including a first thread looping from a lower surface of the insole to an upper surface thereof around said edge, said means for maintaining further including a second thread stitched through all of the layers of the insole to form a seam extending around the insole parallel to an edge thereof, said first thread extending through loops formed by said second thread at said upper surface and through other loops formed by said first thread at said lower surface.

3. The insole recited in claim 1, further comprising an arch support removably attached to a lower surface of said metal foil.

4. The insole recited in claim 1, further comprising a heel support removably attached to a lower surface of said metal foil.

5. A shoe insole comprising:

reflective means including a layer of metal foil for reflecting heat energy to insulate a person's foot;

absorption means for absorbing and temporarily storing moisture from a sole of the person's foot, said absorption means including a layer of felt material forming an uppermost layer in the insole, said layer of metal foil forming a lowermost layer in the insole;

means disposed between said metal foil and said layer of felt material for insulating and cushioning the person's foot, said means for insulating and cushioning including a flexible layer of polyethylene foam;

reinforcement means disposed between said layer of felt material and said layer of polyethylene foam for lending strength and stability to the insole, said reinforcement means including a textile net embedded in a layer of thermoplastic resin; and coupling means for connecting said layer of felt material, said texile net, said layer of polyethylene foam and said metal foil to one another and for maintaining same in an integral configuration.

6. The insole recited in claim 5, further comprising an additional layer of unfoamed polyethylene between said layer of polyethylene foam and said metal foil.

7. The insole recited in claim 6 wherein said coupling means includes a first thread stitched through all of the layers of the insole to form a seam extending around the insole parallel to an edge thereof, said coupling means further including a second thread looping from a lower surface of the insole to an upper surface thereof around said edge, said second thread extending through loops formed by said first thread at said upper surface and through other loops formed by said first thread at said lower surface.

8. The insole recited in claim 7, further comprising an arch support removably attached to a lower surface of said metal foil.

9. The insole recited in claim 8 wherein said arch support is attached to said metal foil by means of an adhesive.

10. The insole recited in claim 9, further comprising a heel support removably attached to a lower surface of said metal foil.

11. The insole recited in claim 10 wherein said heel support is attached to said metal foil by means of an adhesive.

12. The insole recited in claim 11 wherein said layer of metal foil is provided with an embossed pattern.

13. The insole recited in claim 8 wherein said absorption means includes polyethylene and polypropylene in said layer of felt material for performing a cushioning function and an insulating function.

14. The insole recited in claim 8 wherein said arch support is made of a synthetic resin.

15. The insole recited in claim 5 wherein the insole has a peripheral edge, further comprising means for maintaining said edge in a smooth configuration, said means for maintaining including a first thread looping from a lower surface of the insole to an upper surface thereof around said edge, said means for maintaining further including a second thread stitched through all of the layers of the insole to form a seam extending around the insole parallel to said peripheral edge, said first thread extending through loops formed by said second thread at said upper surface and through other loops formed by said second thread at said lower surface.

16. The ihsole recited in claim 5, further comprising an arch support removably attached to a lower surface of said metal foil.

17. The insole recited in claim 16 wherein said arch support is attached to said metal foil by means of an adhesive.

18. The insole recited in claim 16 wherein said arch support is made of a synthetic resin.

19. The insole recited in claim 5, further comprising a heel support removably attached to a lower surface of said metal foil.

20. The insole recited in claim 19 wherein said heel support is attached to said metal foil by means of an adhesive.

21. The insole recited in claim 19 wherein said heel support is made of a synthetic resin.

22. The insole recited in claim 5 wherein said layer of metal foil is provided with an embossed pattern.

23. The insole recited in claim 5 wherein said absorption means includes polyethylene and polypropylene in said layer of felt material for performing a cushioning function and an insulating function.

* * * * *

UNITED STATES PATENT AND TRADEMARK OFFICE

CERTIFICATE OF CORRECTION

PATENT NO. : 4,729,179

DATED : March 8, 1988

INVENTOR(S) : QUIST, Jr.

It is certified that error appears in the above-identified patent and that said Letters Patent is hereby corrected as shown below:

Title page: Abstract, line 10, change "are" to --in--.

Column 1, line 38, change "layer" to --layer of--.

Column 2, line 1, change "heal" to --heel--.

Column 2, line 10, change "person' foot" to --person's foot--.

Column 5, line 2, change "texile" to --textile--.

Column 6, line 15, change "ihsole" to --insole--.

Signed and Sealed this

Sixth Day of September, 1988

*Attest:*

*Attesting Officer*

DONALD J. QUIGG

*Commissioner of Patents and Trademarks*